US005285364A

United States Patent [19]

Bayer

[11] Patent Number: 5,285,364

[45] Date of Patent: Feb. 8, 1994

[54] CHANDELIER TRIMMING INCLUDING SPRING-HOOK

[75] Inventor: Georg Bayer, Plattsburgh, N.Y.

[73] Assignee: Schonbek Worlwide Lighting Inc., Plattsburgh, N.Y.

[21] Appl. No.: 958,693

[22] Filed: Oct. 9, 1992

[51] Int. Cl.[5] ..... F21S 1/06

[52] U.S. Cl. ..... 362/405; 362/433; 362/457; 24/698.3; 248/303

[58] Field of Search ..... 362/339, 405, 406, 433, 362/457, 806; 248/303, 304, 311, 339; 24/370, 371, 601.3, 601.8, 601.9, 698.3; 63/13, 23; D26/138, 145, 154

[56] References Cited

U.S. PATENT DOCUMENTS

| | | | |
|---|---|---|---|
| 528,197 | 10/1894 | Woglom | 63/13 |
| 539,577 | 5/1895 | Elbliein | 248/339 |
| 1,277,483 | 9/1918 | Rogers | 24/698.3 |
| 3,071,938 | 1/1963 | Davidson | 24/601.9 |
| 3,533,139 | 10/1970 | Gomes et al. | 24/703.1 |
| 3,629,571 | 12/1971 | Schonbek | 362/457 |
| 3,820,201 | 6/1974 | Burckhardt | 362/457 |
| 3,981,471 | 9/1976 | Currier | 248/317 |
| 4,135,693 | 1/1979 | Miavitz | 248/304 |

*Primary Examiner*—Ira S. Lazarus
*Assistant Examiner*—Alan B. Cariaso
*Attorney, Agent, or Firm*—Wolf, Greenfield & Sacks

[57] ABSTRACT

A hook and ornament assembly for a chandelier is provided. The assembly includes a hook with a first end terminating in a straight end-segment with a free end. A first ornament defining a straight bore is positioned on the end-segment, with the end-segment extending into the bore. The hook also has a first stop portion for limiting advancement of the first ornament further onto the hook and a second stop portion for limiting advancement of the first ornament off of the free end of the end-segment. The hook is constructed and arranged so that the straight end-segment can be spring biased away from the second stop and so that the first ornament can be positioned on and off the end-segment without permanently bending the hook. Hooks for such assemblies and methods for forming such assemblies also are provided.

23 Claims, 3 Drawing Sheets

CHANDELIER TRIMMING INCLUDING SPRING-HOOK

FIELD OF THE INVENTION

This invention relates to chandelier hook and assemblies.

BACKGROUND OF THE INVENTION

Chandeliers typically include a frame member supporting trimmings of glass ornaments. The ornaments are attached to the chandelier via hooks. An important cost component in manufacturing a chandelier is that cost associated with assembling the ornaments onto the hooks. Two examples are provided in prior art FIGS. 1 and 2.

Referring to FIGS. 1*a–e*, the steps for installing an octagon and glass bead onto a prior art hook are illustrated. The hook 10 of the prior art is pre-formed in a wire-former and has a straight elongated segment 12 with an open loop 14 at one end. (FIG. 1*a*) An ornament in the form of an octagon 16 having a bore (not shown) is inserted via the bore over the free end 18 of the open loop 14. (FIG. 1*b*) The open loop then is shaped into a closed-eye 20 using pliers. (FIG. 1*c*) Next, a glass bead 22 having a central bore (not shown) is threaded onto the free end of the elongated segment 12 and is positioned adjacent to the closed eye 20. (FIG. 1*d*) Finally, the free end of the elongated segment 12 is formed into a frame-engaging loop 24 using a hand-operated machine. (FIG. 1*e*) The axial orientation of the octagon may be adjusted by twisting so that the face of the octagon is properly presented in the hanging orientation. The trimming then is ready for attachment to a chandelier frame. Using the foregoing methodology, an individual can assemble approximately one hundred and seventy (170) pieces of trimming per hour.

Referring to FIGS. 2*a–2d*, the steps for assembling onto a prior-art hook a pair of octagons and a barrel are illustrated. A hook 30 is pre-formed in a wire-former. The hook includes an elongated segment 32 having an open loop 34 at one end. (FIG. 2*a*) A first octagon 36 is threaded onto the free end 38 of the open loop 34 via a bore (not shown) in the octagon. The free end 38 of the open loop 34 then is bent to form a closed-eye 40. (FIG. 2*b*) An ornament in the shape of a barrel 42 then is threaded over the free end of the elongated segment 32 via a through-bore (not shown) in the barrel 42, and the barrel 42 is positioned adjacent to the closed eye 40. A first bend 44 then is placed in the portion of the elongated segment 32 extending from the barrel 42. (FIG. 2*c*) A second octagon 46 then is threaded over the free end of the elongated segment 32, and a second bend 48 is formed adjacent the free end of the elongated segment 32 to secure the second octagon 46 to the hook 30. Approximately two hundred (200) pieces of the foregoing trimming can be assembled by a single worker per hour.

The hooks of the prior art are adapted to facilitate permanent bending using pliers or the like and typically have a tensile strength of between 100,000 and 200,000 p.s.i.

SUMMARY OF THE INVENTION

The invention provides a chandelier trimming that is simple and inexpensive to assemble. The entire hook is pre-formed, and no hand-tooling or machine-tooling is required to secure the ornaments on the hook. The hook also does not need to be adjusted in any manner after securing the ornaments to the hook.

According to one aspect of the invention, a hook and ornament assembly for a chandelier is provided. The hook has a first end terminating in a straight end-segment with a free end. A first ornament defining a straight bore is positioned on the end-segment with the end-segment extending into the bore. A first stop portion of the hook is constructed and arranged to limit advancement of the first ornament further onto the hook, and a second stop portion of the hook is constructed and arranged to limit advancement of the first ornament off of the free end of the end-segment. Advantageously, the hook and ornament are constructed and arranged so that the straight end-segment can be spring-biased away from the second stop so that the first ornament can be positioned on and off of the end-segment. In this manner, the ornament may be locked in position upon the hook without the need to bend the hook subsequent to placing the ornament on the hook. The hook may include a segment that substantially surrounds the ornament.

In a preferred embodiment, the assembly includes a second ornament defining a bore and positioned distally of the end-segment upon the hook via the bore. The bore is constructed and arranged such that the second ornament may be advanced freely over the first stop distally from the straight end-segment. Preferably, the second ornament is positioned upon a hook loop having a loop apex located substantially below the straight segment in a hanging orientation.

The opposite end of the hook may be constructed and arranged in a variety of configurations. For example, it may be in the form of a loop for attachment to a chandelier frame or it may be configured for attachment to another ornament. For example, the opposite end may terminate in a straight end-segment which extends into a bore in the first ornament. A third ornament may be positioned distally of the second end-segment upon the hook via a bore in the third ornament.

According to another aspect of the invention, a chandelier hook for supporting an ornament from a chandelier frame in a hanging orientation is provided. The hook has a first, terminal straight end-segment for supporting an ornament at a first end, and a first bent-segment positioned distally of and at the base of the terminal end-segment. A first loop with a loop apex is positioned substantially below the straight end-segment in the hanging orientation. The hook preferably is constructed and arranged to permit spring-biasing of the first terminal end-segment. The hook may have a second end constructed and arranged for attachments to a chandelier frame. It further may have an elongate shaft portion positioned substantially axially with respect to the end-segment and located between the end-segment and the second end. In another embodiment, the hook includes a second end having a second straight end-segment, a second bent-segment positioned distally of and at the base of the second straight end-segment, and a second loop with a second loop apex.

According to another aspect of the invention, the hook is a wire having a tensile strength of at least 200,000 p.s.i. and most preferably at least 250,000 p.s.i., thereby permitting the spring-biasing hook arrangements of the invention According to still another aspect of the invention, a method is provided for assembling a hook and ornament trimming for a chandelier. A terminal, straight end-segment of the hook is spring biased from a resting position out of alignment with a stop-portion of the hook. An ornament having a bore then is placed onto the terminal end-segment. The end-segment then is permitted to resume the resting position. The ornament is constructed and arranged such that the stop limits advancement of the ornament off of a free end of the straight end-segment in the resting position.

Further aspects of the invention will be understood with reference to the drawings and detailed description of the preferred embodiments.

DETAILED DESCRIPTION OF THE PREFERRED EMBODIMENTS

Figure 1A:
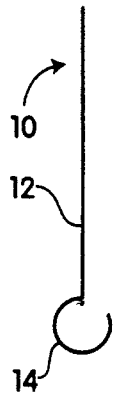
Fig. 1a (Prior Art)
FIGS. 1*a*–1*e* illustrate the steps for installing an octagon and bead on a prior art hook.
Figure 1B:
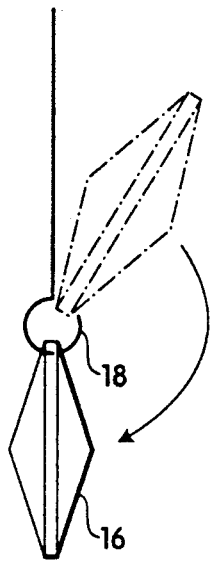
Fig. 1b (Prior Art)
Figure 1C:
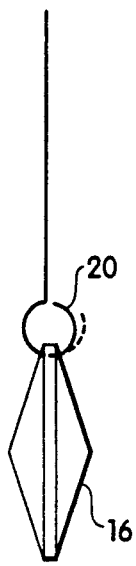
Fig. 1c (Prior Art)
Figure 1D:
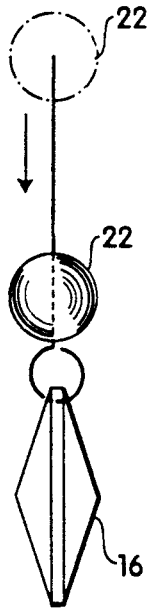
Fig. 1d (Prior Art)
Figure 1E:
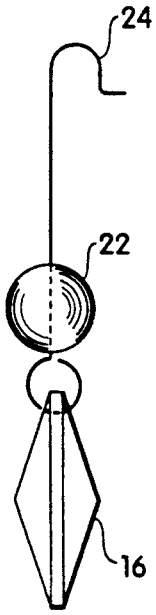
Fig. 1e (Prior Art)
Figure 2A:
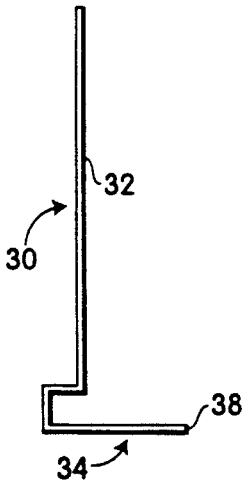
Fig. 2a (Prior Art)
FIG. 2*a*–2*d* illustrate the steps for installing a pair of octagons and a barrel on a prior art hook.
Figure 2B:
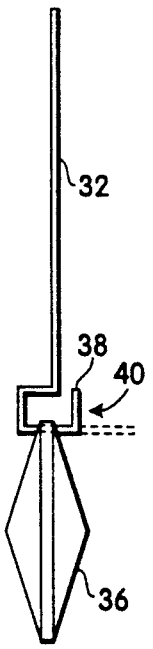
Fig. 2b (Prior Art)
Figure 2C:
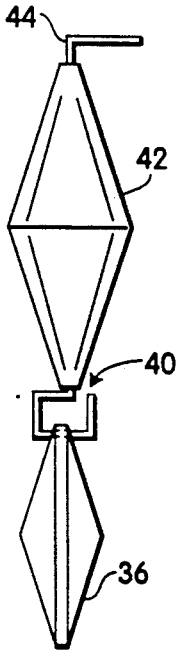
Fig. 2c (Prior Art)
Figure 2D:
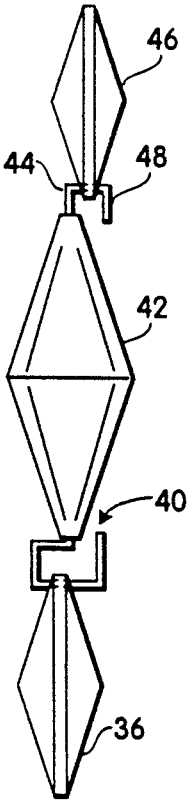
Fig. 2d (Prior Art)

Referring to FIG. 3*a*–3*d*, a hook 50 according to the invention is depicted in its hanging orientation and in its resting position. The hook 50 has a first end 52 configured for attachment to a frame member 53 (in phantom) of a chandelier frame and a second end 54 configured for supporting a pair of ornaments. The ends 52, 54 are separated by an elongate segment 56. The first end 52 of the preferred embodiment has a configuration of a partially-closed loop, described in greater detail in U.S. application Ser. No. 07/705,920, filed May 28, 1991 and entitled CHANDELIER ORNAMENT SHAFT AND FRAME STRUCTURE, the entire disclosure of which is incorporated herein by reference. The first end, however may take on virtually any configuration for attachment to a chandelier frame and the configuration of the first end of this embodiment is not considered to be a part of the invention herein.

The second end 54 extends from the base of the elongate segment 56 and may be described as having three segments. A first segment extends at an angle from the base of the elongate segment 56 and forms a stop 58. The first segment is substantially semicircular. A second segment extends from the base of the first segment and also is substantially semicircular, but facing in the opposite direction of the first segment and having a diameter of about ⅓ that of the first segment. The first and second segments together form an ornament loop with an ornament loop apex 60. A third segment extends at an angle from the end of the second segment and forms therewith a second stop 62. The third segment or straight end-segment 64 terminates at free end 66. The end-segment 64 is substantially axial with but spaced from the elongate segment 56.

Figure 3A:
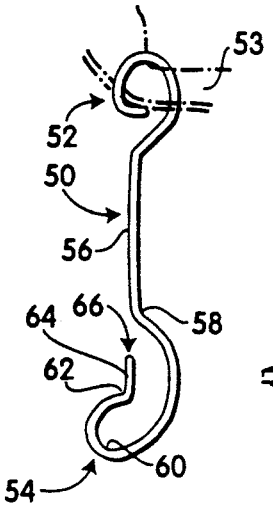
FIGS. 3*a*–3*d* illustrate the steps for installing an octagon and bead on a hook according to the invention.
Figure 3B:
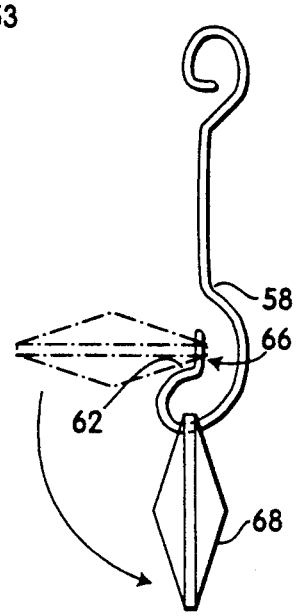
Figure 3C:
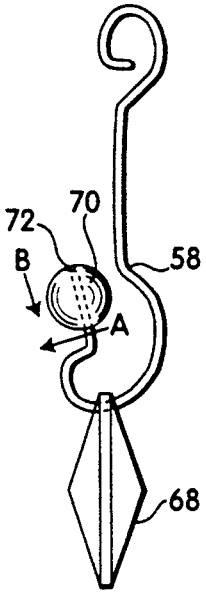
Figure 3D:
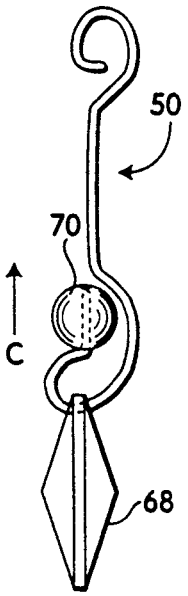

A pair of ornaments may be assembled onto the hook of FIG. 3*a* as follows. An ornament such as an octagon 68 defining a bore (not shown) is positioned on the hook by threading the bore over the free end 66 of the end-segment 64 (FIG. 3*b*). The bore is constructed and arranged with respect to the second stop 62 such that the octagon may be advanced freely over the second stop in a direction distally of the straight end-segment. As used herein, distal advancement means advancement from a straight end-segment in a direction toward the center of the hook. The octagon is advanced until it reaches the ornament loop apex 60, which is the lowest part of the ornament loop formed by the first and second segments of the second end 54. As will be readily understood by one of ordinary skill in the art, gravity will maintain the octagon at this position. Next, the straight end-segment 64 is spring-biased in the direction of arrow A out of axial alignment with the elongate segment 56 to open the space between the free end 66 of the end-segment 54 and the first stop 58. Then, an ornament such as a glass bead 70 having a through-bore 72 is threaded onto the straight end-segment 64 in the direction of arrow B. The biasing of the end-segment 64 permits the glass bead 70 to pass beyond the first stop 58. The glass bead 70 is advanced until it reaches stop 62. The hook then is permitted to resume its resting position (FIG. 3*d*). In the resting position, the stop 58 prevents removal of the glass bead 70 from the free end 66 of the end-segment 64. Thus, the octagon and glass bead may be assembled onto the hook of the invention without the need for any accessory tools or further permanent bending of the hook. Approximately 600 such trimmings may be assembled by a single worker per hour.

Figure 4:
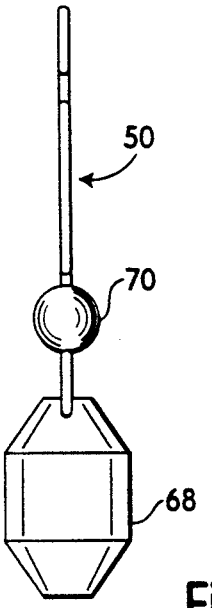
FIG. 4 is a front view of the assembly of FIG. 3*d*.

FIG. 4 depicts a front view of the assembly of FIG. 3*d*. As will be readily understood, this front profile presents virtually the same profile as a trimming manufactured using the hook of the prior art.

Referring to FIGS. 5*a*–5*d*, another trimming according to the invention is provided. In this embodiment, both ends of the hook 80 are adapted to support ornaments. The ends have the general shape of a question mark; that is, a looped portion 82 terminating in a terminal, straight end-segment 84. Each looped portion 82 forms at its juncture with a corresponding end-segment 84 a stop 83. The end-segments are axially aligned with their free ends 86 facing one another and spaced apart from one another. The looped portions 82 are joined to one another by an elongate segment. The elongate segment is formed of two substantially straight segments 88 joined to one another at an obtuse angle.

The ornaments are assembled onto the hook as follows. First, ornaments such as octagons 90 are threaded onto the free ends 86 of the terminal end-segments 84 via a bore (not shown) in the octagons. As described above in connection with FIGS. 3*a*–3*d*, the bores of the octagons are constructed and arranged with respect to stops 83 such that the octagons may be advanced freely over the stops distally from the straight end-segments. (FIG. 5*b*). Next, the end-segments 84 are biased in a direction away from the straight segments 88 (in the direction of arrows D and E), and the free ends 86 of the end-segments 84 are inserted into opposing bores 92 in an ornament such as a barrel 94. As will be understood by one of ordinary skill in the art, the bores 92 need not join one another. That is, it is not necessary to have a through-bore. Instead, the bores 92 may be blind openings of sufficient depth for receiving a portion of the end segments 84. It should also be noted that while a jeweled ornament such as the barrel 94 is utilized according to this embodiment, it is equally possible to employ a tubular ornament having a lumen extending partially or entirely therethrough. Other shapes are also contemplated according to this invention.

Figure 6:
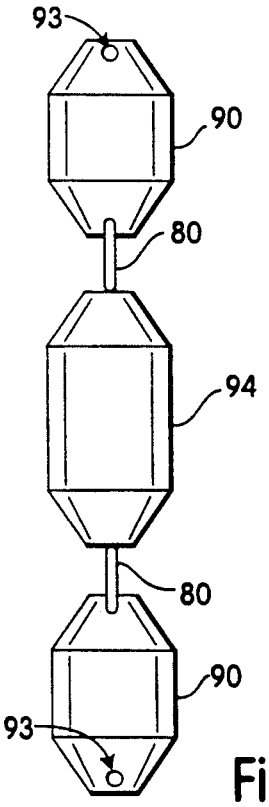
FIG. 6 is a front view of the assembly of FIG. 5*d*.
Figure 5D:
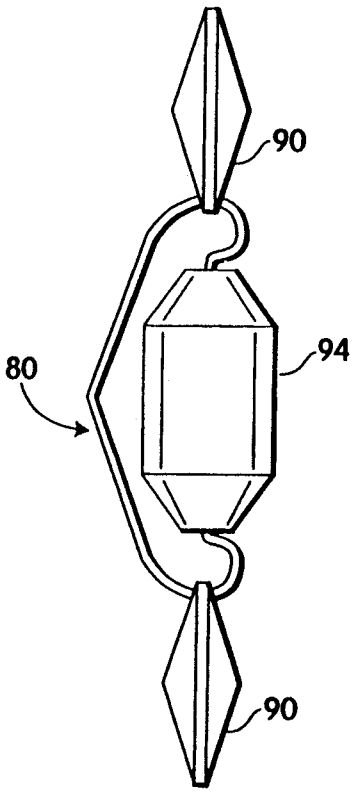
FIGS. 5*a*–5*d* illustrate the steps for installing a pair of octagons and a barrel on a hook according the invention.
Figure 5C:
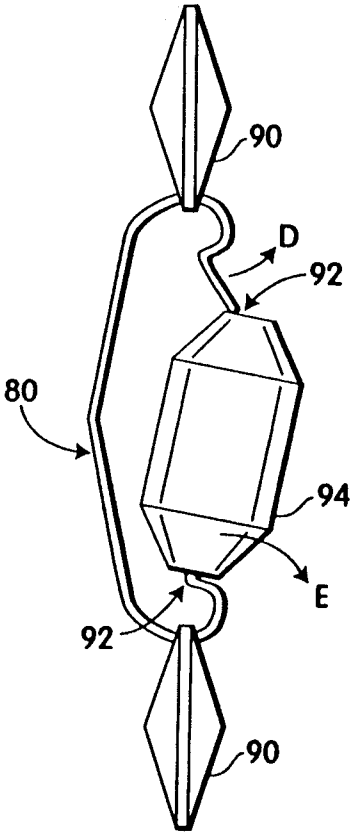
Figure 5B:
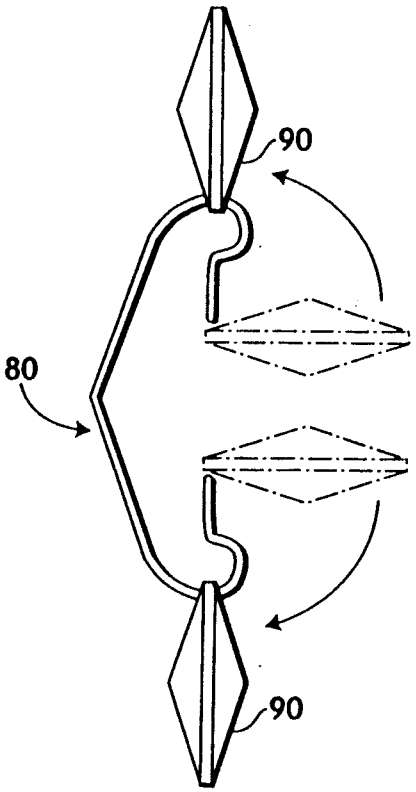
Figure 5A:
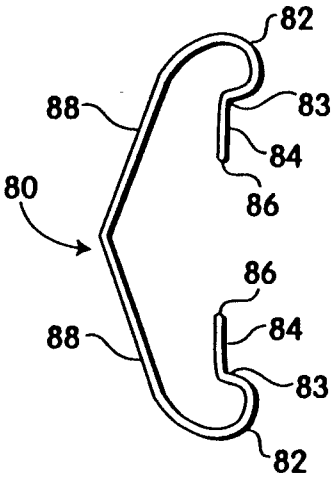

FIG. 6 is a front view of the assembly of FIG. 5*d*. As was the case with FIG. 4, this front profile presents virtually the same profile as a trimming manufactured using the hook of the prior art. Note that each of the ornaments 90 includes a second bore 93 positioned remote from the hook 80, that can be used for attachment of further hooks or other attachment devices that are known to those of ordinary skill in the art. The foregoing are only examples of hook and ornament assemblies according to the invention. As will be readily understood by one of ordinary skill in the art, limitless hook and ornament shapes are possible, provided that the ornament and hook are constructed and arranged so that temporary biasing permits clearance for putting the ornament on the hook and so that once assembled and in the resting position, the hook provides a stop preventing unintended disengagement of the ornament from the hook via the free end of the hook. The preferred hooks are made of stainless steel and are full spring temper, the highest tensile strength available. The wire was obtained from Fairbanks Wire Corporation, Addison Ill. and is designated Type 302 stainless steel, 275,000–300,000 psi tensile strength, 0.030 inches in diameter, polycrystal die, diamond drawn, federal specification QQW 423B.

As discussed above, the preferred loops for supporting the hook on a frame member of a chandelier are shown in U.S. patent application Ser. No. 07/705,920. Such loop and frame arrangements not only prevent unintended dislodgment of the trimming from the chandelier frame, but also assist in properly orienting the hook with respect to the frame. As will be understood by reference to FIG. 3*d* and FIG. 5*d*, the hooks of the invention have a portion that substantially surrounds the ornament. By substantially surrounds it is meant that a segment of the hook surrounds approximately ½ of the ornament. Thus, referring to FIG. 3*d*, the first semicircular segment of the hook surrounds the ornament on the right hand side from the opening at the top of the ornament to the opening at the bottom of the ornament. The same is true of the ornament in the shape of a barrel in FIG. 5*d*. As can be seen, the hook segments 88 extend approximately half way about the barrel 94 from the opening 92 at the top of the barrel to the opening 92 at the bottom of the barrel. In this instance, the barrel has a greatest dimension defined by the axis connecting openings 92, and the hook segments 88 extend substantially about the ornament along this greatest dimension. (For the purposes herein, a sphere may be said to have a greatest dimension, that is, its diameter.) In order to obscure the portion of the hook surrounding the ornament, it is important that the ornament be oriented in a hanging position such that the front of the ornament as shown in FIGS. 4 and FIG. 6 is exposed with the portion of the hook surrounding the ornaments obscured from viewing. The loop and frame arrangements identified in U.S. patent application Ser. No. 07/705,920 permit such specific orientation of the ornament. As will be readily understood by those of ordinary skill in the art, however, numerous other hook and frame arrangements would accomplish the same goal of proper orientation of the hook in the hanging position.

It should be understood that the preceding is merely a detailed description of certain preferred embodiments. It therefore should be apparent to those skilled in the art that various modifications and equivalents can be made without departing from the spirit or scope of the invention.

What is claimed is:

1. A hook and ornament assembly for a chandelier comprising a hook for the chandelier having a first end terminating in a straight end-segment with a free end, a first ornament defining a straight bore positioned on the end-segment with the end-segment extending into the bore, a first stop portion of the hook constructed and arranged to limit advancement of the first ornament further onto the hook, a second stop portion of the hook constructed and arranged to limit advancement of the first ornament off of the free end of the end-segment, and a second ornament defining a bore and positioned distally of the end-segment upon the hook, via the bore of the second ornament, the bore of the second ornament being constructed and arranged so that the second ornament can be advanced over the first stop distally from the straight end-segment.

2. A hook and ornament assembly as claimed in claim 1 wherein the hook and ornament are constructed and arranged so that the straight end-segment can be spring-biased away from the second stop and so that the first ornament can be positioned on and off of the end-segment without permanently bending the hook.

3. A hook and ornament assembly as claimed in claim 1 wherein the assembly has a hanging orientation and wherein the second ornament is positioned substantially beneath the first ornament in the hanging orientation.

4. A hook and ornament assembly as claimed in claim 3 wherein the second ornament is positioned upon a hook loop having a loop apex located substantially below the straight segment in the hanging orientation.

5. A hook and ornament assembly as claimed in claim 1 wherein the hook includes an elongate shaft positioned substantially axially with respect to the end-segment.

6. A hook and ornament assembly as claimed in claims 1, 2, 3, 4, or 5 wherein the hook is a wire having a tensile strength of at least 250,000 p.s.i.

7. A hook and ornament assembly as claimed in claims 1 or 3 wherein the hook has a second end constructed and arranged with a loop for attachment to a chandelier frame.

8. A hook and ornament assembly as claimed in claim 1 or 4 wherein the hook has a second end terminating in a second straight end-segment and wherein the second straight end-segment extends into the bore of the first ornament.

9. A hook and ornament assembly as claimed in claim 8 further comprising a third ornament defining a bore and positioned distally of the second end-segment upon the hook via the bore.

10. A hook and ornament assembly as claimed in claim 9 further comprising a third stop on the hook adjacent the second straight end-segment, the third stop being constructed and arranged to limit advancement of the first ornament further onto the hook via the second straight end-segment and wherein the bore of the third ornament is constructed and arranged such that the third ornament can be advanced freely over the third stop distally from the second straight end-segment.

11. A hook and ornament assembly as claimed in claim 1 wherein the hook includes a hook segment substantially surrounding the first ornament.

12. A hook and ornament assembly as claimed in claim 1 wherein the first ornament has a greatest dimension and wherein the bore extends substantially axially with respect to the greatest dimension.

13. A hook and ornament assembly as claimed in claim 1 wherein the first ornament has a greatest dimension and wherein the hook includes a hook segment surrounding a substantial portion of the first ornament along the greatest dimension.

14. A chandelier hook for supporting an ornament from a chandelier frame in a hanging orientation comprising a first, terminal, straight end-segment for supporting the ornament at a first end, a first bent-segment positioned distally of a base of the first straight end-segment, opposite a free end of the first straight end-segment, the first bent-segment being constructed and arranged to limit further distal movement of the ornament, and a first loop with a loop apex positioned substantially below the straight end-segment in the hanging orientation, the first loop being constructed and arranged to support another ornament having a bore substantially at the loop apex, the ornament at the first end limiting movement of the other ornament off the end-segment.

15. A chandelier hook as claimed in claim 14 wherein the hook is constructed and arranged to permit spring-biasing of the first terminal end-segment.

16. A chandelier hook as claimed in claim 15 wherein the hook is a wire having a tensile strength of at least 250,000 p.s.i.

17. A chandelier hook as claimed in claim 16 wherein the hook includes an elongate shaft portion positioned substantially axially with respect to the end-segment and located between the end-segment and the second end.

18. A chandelier hook for supporting an ornament from a chandelier frame in a hanging orientation comprising a first, terminal, straight end-segment for supporting the ornament at a first end, a first bent-segment positioned distally of a base of the first straight-end-segment, opposite a free end of the first straight end-segment, a first loop apex positioned substantially below the straight end-segment in the hanging orientation, a second straight end-segment positioned on the hook at a second end remote from the first straight end-segment, a second bent-segment positioned distally of a base of the second straight end-segment, opposite a free end of the second straight end-segment, and a second loop with a second loop apex positioned substantially above the second straight end-segment in the hanging orientation, wherein the hook is constructed and arranged to permit spring-biasing of at least the first straight end-segment.

19. A method for assembling a hook and ornament assembly for a chandelier comprising passing a first ornament having a bore over a, terminal, straight end-segment of a hook of the chandelier and onto an apex of the hook, spring-biasing, from a resting position, the, terminal, straight end-segment of the hook out of alignment with a stop portion of the hook, placing a second ornament having a bore onto the, terminal, straight end-segment, and permitting the straight end-segment to resume the resting position, wherein the second ornament is constructed and arranged such that the stop portion of the hook limits advancement of the ornament off of a free end of the straight end-segment in the resting position and the second ornament limits advancement of the first ornament off of the free end of the end-segment in the resting position.

20. A hook for a chandelier frame trimming comprising:

an elongate segment attached to an apex for supporting a first ornament in a hanging orientation with respect to the chandelier frame;

a first stop portion attached to the apex and located distally of the apex, remote from the elongate segment;

a straight end-segment located distally of the first stop portion, remote from the apex, the straight end-segment including a free end, each of the end-segment and the stop portion being constructed and arranged to receive a bore of a second ornament, the first stop portion limiting advancement of the second ornament onto the apex; and the elongate segment further including a second stop portion that resists passage of the first ornament off of the straight-end-segment, wherein each of the elongate segment, the apex, the first stop portion, the straight end-segment and the second stop portion are formed as part of a single and continuous shaft that is free of breaks therealong.

21. A hook as set forth in claim 20 wherein each of the first ornament and the second ornament are substantially axially aligned with at least a portion of the elongate segment proximate the apex in the hanging orientation.

22. A hook as set forth in claim 20 wherein the second stop portion comprises a loop located adjacent the apex, remote from the first stop portion.

23. A hook as set forth in claim 20 wherein the second stop portion comprises another straight end-segment located remote from the straight end-segment, the other straight end-segment engaging an opposing bore of the second ornament to limit advancement of the second ornament out of the straight end-segment.

* * * * *